US007043807B2

(12) United States Patent
Woyciesjes et al.

(10) Patent No.: US 7,043,807 B2
(45) Date of Patent: May 16, 2006

(54) MODULAR RIVET TOOL

(75) Inventors: James N. Woyciesjes, Milford, CT (US); Theordore S. Komsta, Shelton, CT (US); Richard J. Babyak, Conway, SC (US)

(73) Assignee: Newfrey LLC, Newark, DE (US)

( * ) Notice: Subject to any disclaimer, the term of this patent is extended or adjusted under 35 U.S.C. 154(b) by 0 days.

(21) Appl. No.: 11/199,438

(22) Filed: Aug. 8, 2005

(65) Prior Publication Data

US 2005/0268447 A1 Dec. 8, 2005

Related U.S. Application Data

(63) Continuation of application No. 10/718,494, filed on Nov. 20, 2003, now Pat. No. 6,925,695.

(60) Provisional application No. 60/428,116, filed on Nov. 21, 2002.

(51) Int. Cl.
*B21J 15/34* (2006.01)
*B21J 15/22* (2006.01)

(52) U.S. Cl. ..... 29/243.525; 29/243.523

(58) Field of Classification Search ..... 29/243.521, 29/243.523, 243.524, 243.525
See application file for complete search history.

(56) References Cited

U.S. PATENT DOCUMENTS

| | | | | |
|---|---|---|---|---|
| 4,281,531 | A | 8/1981 | Ehmann et al. | |
| 4,515,005 | A | 5/1985 | Klein | |
| 4,598,571 | A | 7/1986 | Oefinger | |
| 4,770,023 | A | 9/1988 | Gast et al. | |
| 4,887,450 | A | 12/1989 | Gast et al. | |
| 4,888,974 | A | 12/1989 | Mandell | |
| 5,086,551 | A | 2/1992 | Shamaly et al. | |
| 5,490,312 | A | 2/1996 | Smith | |
| 5,500,900 | A | 3/1996 | Chen et al. | |
| 5,598,619 | A | 2/1997 | Rosier | |
| 5,697,136 | A | 12/1997 | Frearson et al. | |
| 6,163,945 | A | 12/2000 | Amano et al. | |
| 6,276,037 | B1 | 8/2001 | Solfronk | |
| 6,425,170 | B1 | 7/2002 | Zirps et al. | |
| 6,622,363 | B1 | 9/2003 | Komsta | |
| 6,925,695 | B1 * | 8/2005 | Woyciesjes et al. | ... 29/243.525 |

* cited by examiner

*Primary Examiner*—David Jones
(74) *Attorney, Agent, or Firm*—Harness, Dickey & Pierce, P.L.C.

(57) ABSTRACT

A rivet setting tool is provided with a mandrel collection system. The mandrel collection system uses a valve system to provide high and low vacuum states to draw rivet mandrels into a collection bottle. The low vacuum state provides an energy savings and reduced noise levels.

26 Claims, 13 Drawing Sheets

MODULAR RIVET TOOL

CROSS-REFERENCE TO RELATED APPLICATIONS

This application is a continuation application of U.S. patent application Ser. No. 10/718,494 filed on Nov. 20, 2003 now U.S. Pat. No. 6,925,659 which claims the benefit of U.S. Provisional Application No. 60/428,116, filed on Nov. 21, 2002. The disclosure of the above applications is incorporated herein by reference.

FIELD OF THE INVENTION

The present invention relates generally to rivet setting tools, and more particularly to a mandrel collection system for a rivet setting tool.

BACKGROUND OF THE INVENTION

Various types of rivet setting tools are known in the industry. Some include spring actuated, pneumatically actuated, hydraulically actuated systems and combinations thereof. As rivet setting tools have developed, manufacturers strive to improve the efficiency, reduce the complexity and increase an operator's ease in handling the tool.

Rivet setting tools using pneumatic actuation to withdraw a spent mandrel from the rivet setting tool into a collection system typically apply a constant vacuum or air pressure to the rivet setting tool. Often the mechanism to create a vacuum can utilize a constant stream of compressed air. Unfortunately, the vacuum is really only needed immediately after the rivet is being set. The constant flow of highly compressed air is therefore an inefficient from an energy standpoint as well as a source of a significant amount of unnecessary noise.

It is therefore desirable in the industry to provide a rivet setting tool having a mandrel collection system that can vary the amount of mandrel collection vacuum depending upon the time within a duty cycle. Additionally, it would be desirable to provide which can be quickly adapted for varying sizes of rivets and easily disassembled for cleaning and general maintenance. It is an object of the present invention to provide a rivet setting tool, which overcomes the deficiencies in the prior art.

SUMMARY OF THE INVENTION

In one embodiment of the invention, a hand held tool for setting a rivet having a rivet having a removable mandrel is disclosed. A mandrel collection system coupled to the rivet setting tool is provided, which is configured to provide first and second vacuum levels, with the second vacuum level being sufficient to draw the mandrel from the rivet setting tool into the mandrel collection system. The first vacuum level is less than the second vacuum level.

In another embodiment of the invention, an apparatus for setting a fastener having a mandrel is disclosed. The apparatus has an air supply module; a vacuum control module coupled to the air supply module; and a collection bottle defining a generally sealed collection cavity. The vacuum control module is configured to provide first and second vacuum levels within the generally sealed cavity, said second vacuum level being sufficient to draw the mandrel into the sealed cavity.

In another embodiment of the invention, an apparatus for moving a portion of a fastener from one location to another is disclosed. The apparatus has a vacuum control module and a member defining a generally sealed cavity. The vacuum control module is configured to provide first and second vacuum levels within the sealed cavity. The second vacuum being sufficient to draw the portion of the fastener into the sealed cavity, while the first vacuum level is not sufficient to draw the portion of the fastener into the sealed cavity.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

Figure 1A:
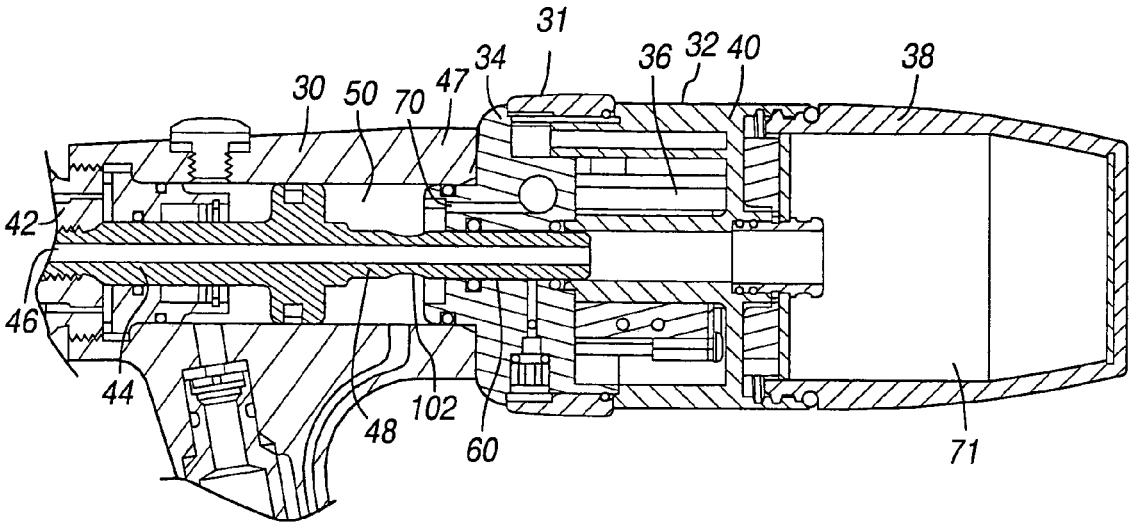
FIGS. 1*a* and 1*b* represent cross-sectional views of the rivet setting tool having a mandrel collection system according to the teachings of the present invention.
Figure 1B:
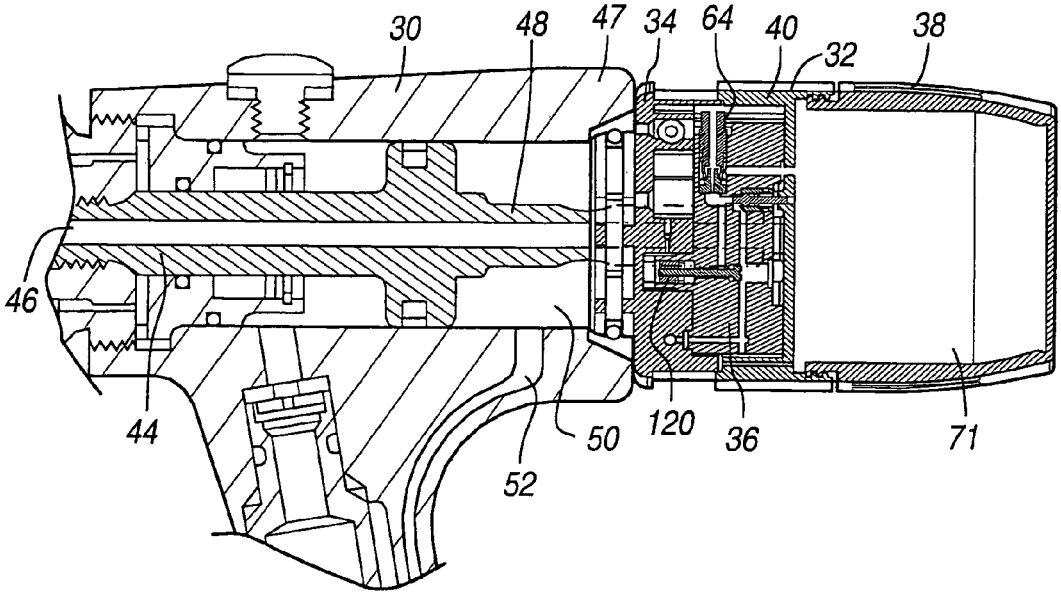

With reference to FIGS. 1*a* and 1*b* which show a rivet setting tool 30 having a mandrel collection system 32 according to the teachings of the present invention. The mandrel collection system is formed of four components that are axially fixed to the rivet setting tool 30. The mandrel collection system 32 is formed of an air supply module 34, a vacuum control module 36, a collector bottle 38, and a mandrel collection system body 40. The mandrel collection system 32 provides a mechanism which is capable of automatically switching from a "low vacuum" level to a "high vacuum" level for a predetermined amount of time. In this regard, the system is configured to provide a low vacuum state when the rivet setting tool is not being actuated and a "high vacuum" state for when a mandrel must be drawn from the actuating head 42 of the rivet setting tool 30. The air supply module 34 contains a switch mechanism to activate the mandrel collection system 32 and supply the vacuum control module 34 with air to generate a vacuum. The collector bottle stores spent rivet mandrels pulled in from the tool via the vacuum control module 36.

The mandrel collection system 32 uses movement of the rivet setting tools' actuation hydraulic piston 44 to actuate the mandrel collection system 32. Upon actuation of the actuating head 42 of the rivet setting tool 30, the movement of the actuating piston 44 causes the mandrel collection system 32 to increase the amount of vacuum within a collection bottle to draw the rivet mandrel through the rivet mandrel collection tube 46 defined within the actuation piston 44. When the mandrel collection system 32 is activated or "turned on" via the switch mechanism 31 in the air supply module 34, a constant vacuum is generated by the vacuum control module 36. The level of the constant vacuum is regulated by a needle valve (as disclosed below). This level can be adjusted all the way from full vacuum capability of the mandrel collection system to completely off.

FIG. 1*b* represents a cross-sectional view of mandrel collection system 32 shown in FIG. 1*a*. The mandrel collection system 32 is coupled to an aft portion 47 of the rivet setting tool 30 using a coupling mechanism. In this regard, the coupling mechanism can be a threaded flange or the mandrel collection system 32 can be coupled to the rivet setting tool 30 using a number of threaded fasteners. Additionally, the mandrel collection system 32 can be coupled to the rivet setting tool 30 using a snap ring assembly or other applicable coupling mechanisms.

The mandrel collection system 32 defines a through bore 60 that slidably accepts the mandrel collection actuator 48 of the actuating piston 44. Additionally, the mandrel collection system 32 defines a compressed air inlet 70 that receives compressed air from the rivet setting tool 30. The compressed air supply 70 functions to provide compressed air to the vacuum control module and a valving mechanism 64 within the mandrel collection system 32.

Inside the vacuum control module 36 is a valve mechanism. In the constant vacuum or low flow mode, the valve mechanism is in a closed position allowing air to pass down a low flow path and sealing a high flow path causing a vacuum transducer to generate a constant "low vacuum" level. This low vacuum level is obtained by restricting the flow of the vacuum transducer via a flow control needle valve. The high flow mode of the mandrel control system 32 is activated by supplying air pressure to the chamber at the bottom of the valve and pushing the valve up to a high flow position via air pressure over differential areas. The air is supplied via an air valve located on the actuating piston 44 of the rivet setting tool 30 which is actuated when the tool is cycled. When the valve is opened, the air supply from the air supply module 34 is allowed to bypass the restriction from the needle valve and goes directly to the vacuum transducer, creating a high vacuum condition from the full, unrestricted flow of the supply. When the cycle of the tool is completed, the air supply to the valve is cut off. Once the supply is cut off, the air pressure begins to reduce back to atmospheric pressure via a bleed orifice that is ported off the air chamber beneath the valve. The pressure "leaks" out at a rate dependent on the size of the orifice. It, therefore, takes a certain period of time for the chamber beneath the valve to evacuate. This "bleed off" time is the timer mechanism for the mandrel collection system 32. As the chamber evacuates, the valve begins to close, closing off the high flow air path and restoring the mandrel collection system to a low flow mode. A detailed description of the functioning of the system and its components is made below.

Figure 2:
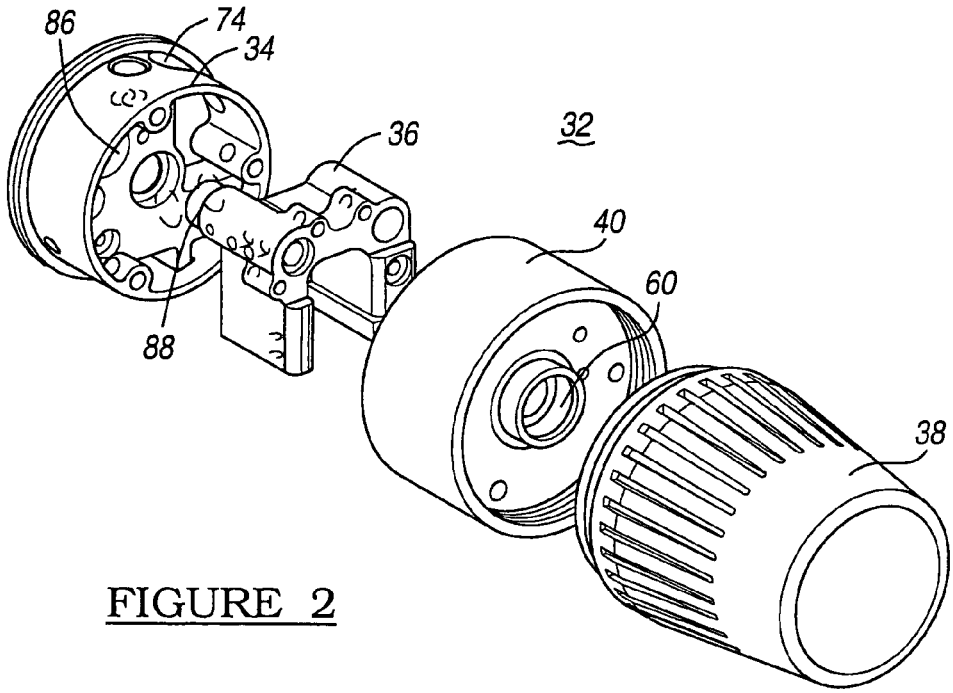
FIG. 2 represents an exploded view of the mandrel collection system shown in FIG. 1*a;*

FIG. 2 represents a perspective exploded view of the mandrel collection system 32 shown in FIGS. 1*a* and 1*b*. Shown are the air supply module 34, the vacuum control module 36, the collector bottle 38, and the mandrel collection system body 40. The mandrel collection system 32 is configured so the mandrel collection system body 40 and collector bottle 38 define a collection vacuum chamber 71. Further, the mandrel collection system body 40 couples to the air supply module 34 to enclose the vacuum control module 36.

Figure 3:
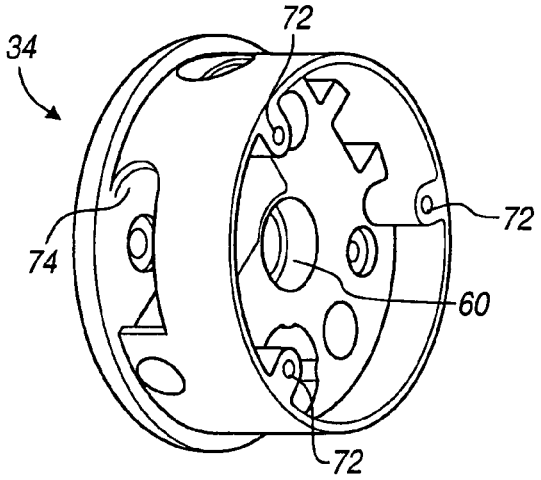
FIGS. 3–8 represent the air supply module for the mandrel control system shown in FIG. 1.
Figure 4:
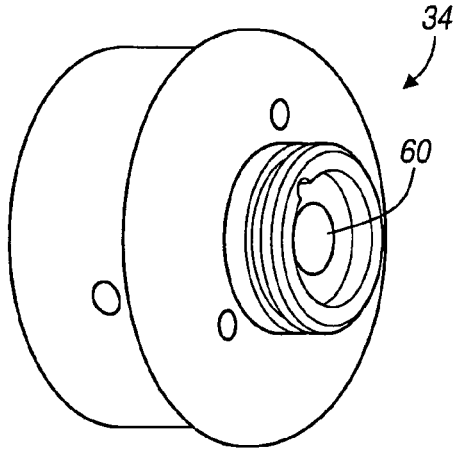
Figure 5:
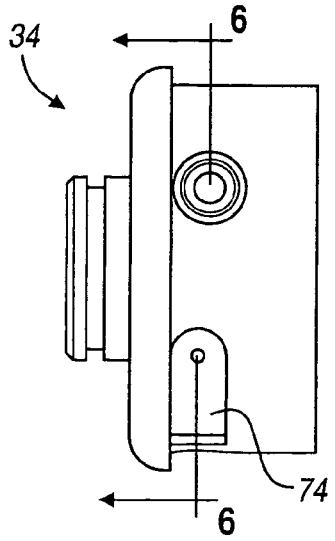

FIGS. 3–8 represent views of the air supply module 34. As best seen in FIG. 3, the exterior surface of the air supply module 34 defines a plurality of threaded bores 72 which are used to couple the vacuum control module 36 and the mandrel collection system body 40 to the air supply module 34. As seen in FIGS. 3 and 5, the air supply module further defines an air exhaust port 74 for the release of compressed air from the vacuum control module 36 and the air supply module 34.

Figure 6:
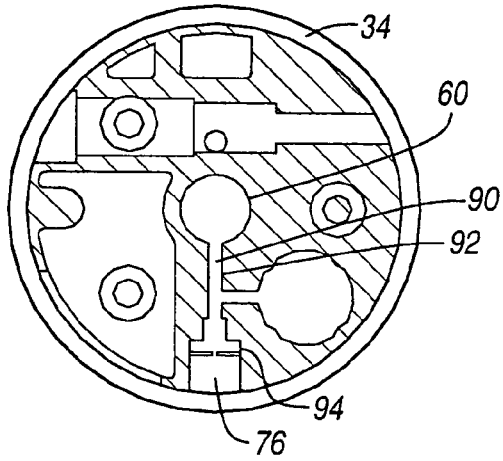
Figure 7:
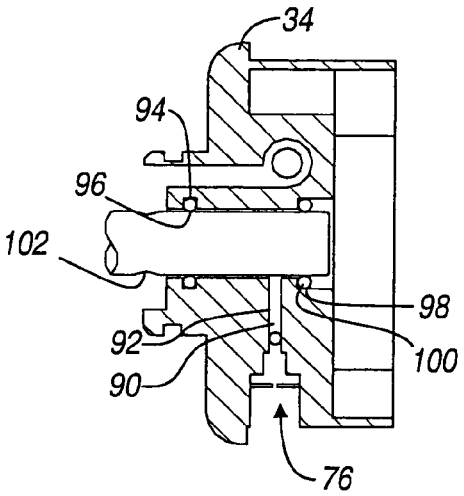

FIGS. 6–7 represent cross-sectional views of the air supply. Shown is a plurality of apertures and a chamber defined within the body of the air supply module 34. Defined within the air supply module is the compressed air supply inlet which functions to bring a constant air pressure from the rivet setting tool 30 into the valving mechanism 64 of the mandrel collection system 32. Additionally defined within the body is a chamber, which is fluidly coupled to the central aperture. Additionally coupled to the central aperture is a chamber having a leak control orifice 76. The leak control orifice 76 functions to use pressure built within the chamber to supply a stream of pressurized air to a shuttle valve as will be further described below.

Figure 8:
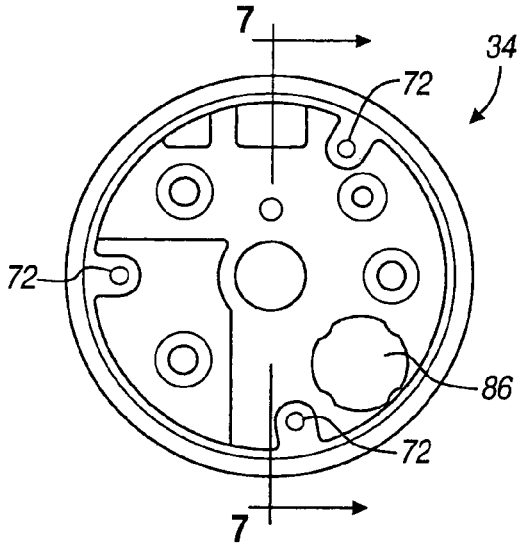

As seen in FIG. 8, the air supply module 34 defines a plurality of coupling orifices, which mate with a corresponding set of orifices in the vacuum control module and the mandrel collection system body 40. Additionally, the air supply module defines a recessed portion 86, which slidably accepts a post portion 88 of the vacuum control module 36.

As best seen in FIGS. 6 and 7, the leak control aperture 90 is configured of two separate sections. The first portion 92 has a first diameter, while the second section has a second diameter 94. Disposed within the second section is a 0.005 inch disk having an aperture formed by the use of a laser. The aperture in the disk has a diameter of about 0.0012 to 0.0025 inches in diameter. Modification of the diameter of the aperture as well as the pressure regulates the timing of the actuation of the vacuum control module 36.

As previously mentioned, the air supply module 34 has a through bore 60. Axially disposed about the through bore is a first groove that holds a first O-ring 96. Also disposed about the through bore is a shelf portion 98 that holds a second O-ring 100. The first O-ring 96 functions in conjunction with one or more longitudinally formed slots or chamfers 102 defined within the actuating piston 44 to form a gas actuator as further described below.

FIGS. 9*a*–9*d* represent views of the vacuum control module 36. The vacuum control module 36 defines a plurality of input ports and output ports. Similarly, disposed within the air control module 34 is a plurality of interconnected apertures with a set of corresponding valves which effect the production of a vacuum within the vacuum control module 36.

Figure 9A:
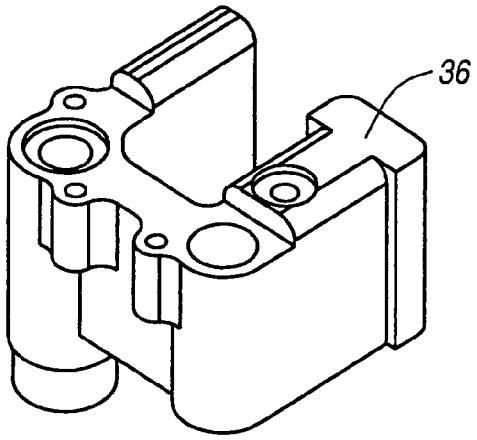
FIGS. 9*a*–9*d* represent the vacuum control module shown in FIG. 2.
Figure 9B:
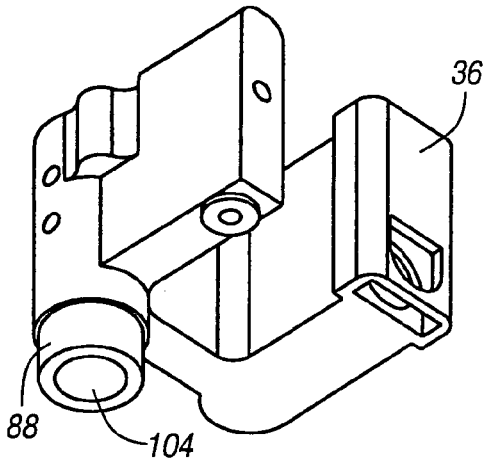
Figure 9C:
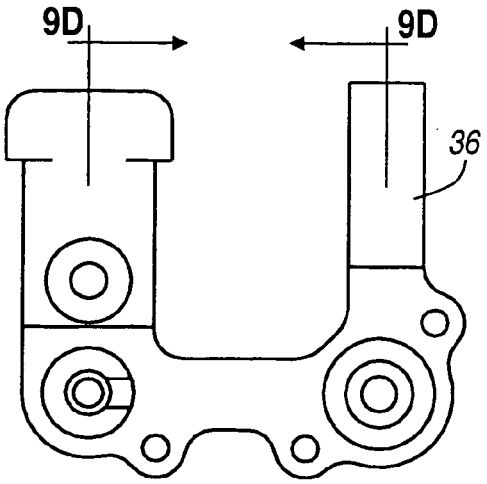
Figure 9D:
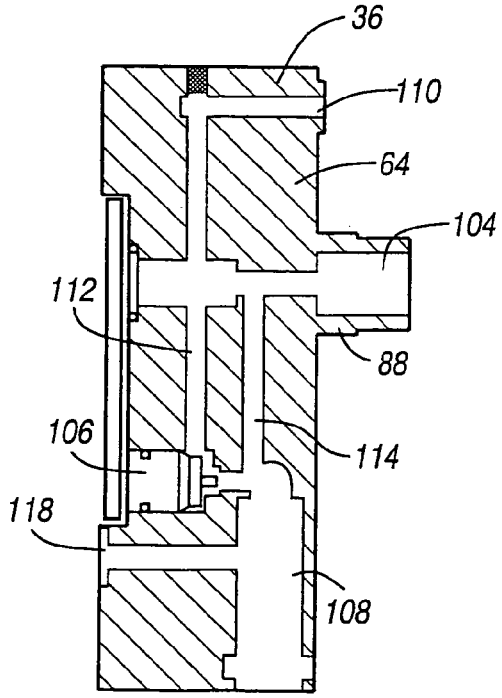

As best seen in FIG. 9*d*, the vacuum module 36 defines a shuttle valve chamber 104, a constant/low flow needle valve control chamber 106, and a vacuum transducer chamber 108. Further disclosed within the system is a constant air supply passage 110 which coupled to the constant air supply 70. Further defined within the vacuum control module is a low flow passage 112 and a high flow passage 114. The function of these passages and chambers will be described in detail below.

Figure 10A:
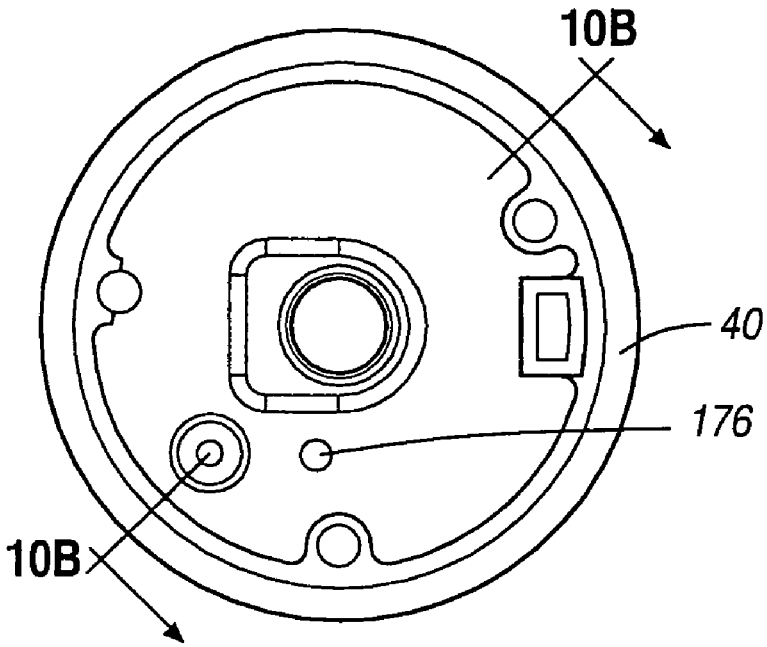
FIGS. 10*a*–10*b* represent the mandrel collection system body shown in FIG. 2.
Figure 10B:
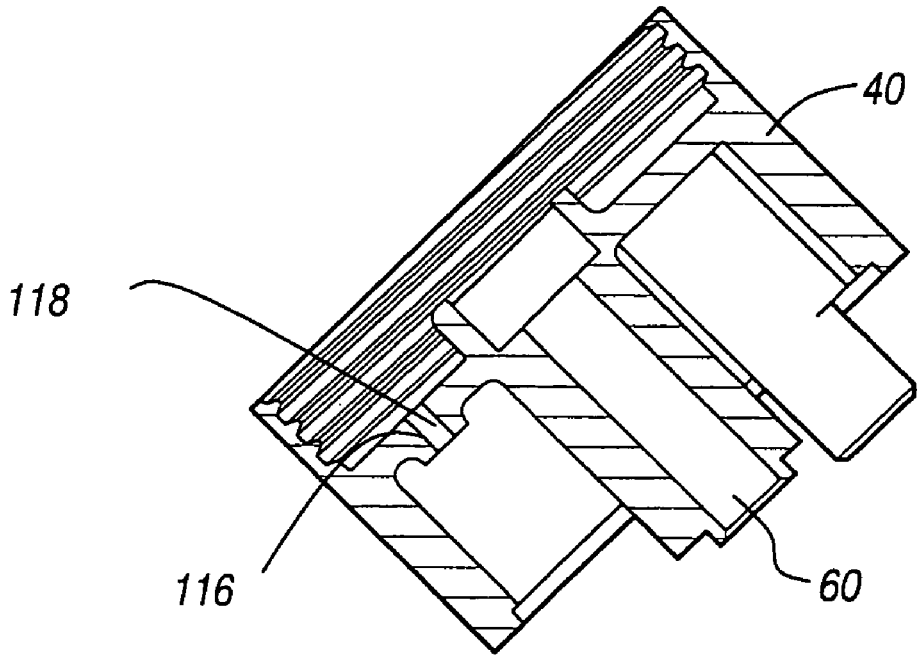

FIGS. 10*a*–10*b* represent a module collection system body 40. As can be seen, the module collection system body defines a through bore 60 that slidably accepts the hydraulic piston. Defined at one end of the coupling member is a vacuum or aperture 116 that fluidly couples the collector bottle 38 to the vacuum supply line 118 defined within the vacuum control module 36.

Figure 11A:
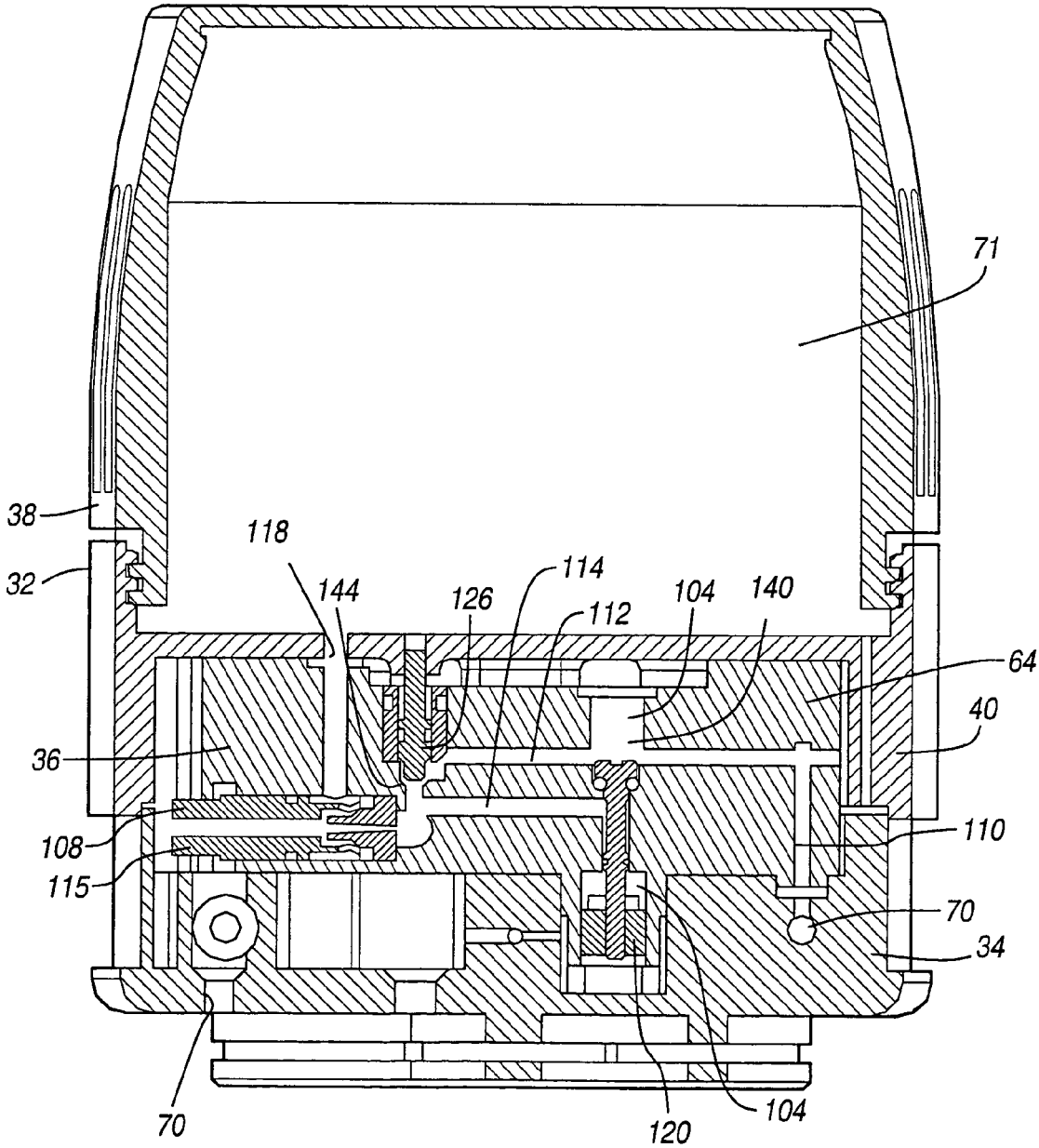
FIGS. 11*a*–11*b* represent cross-sectional and side views of the mandrel collection system shown in FIG. 1.
Figure 11B:
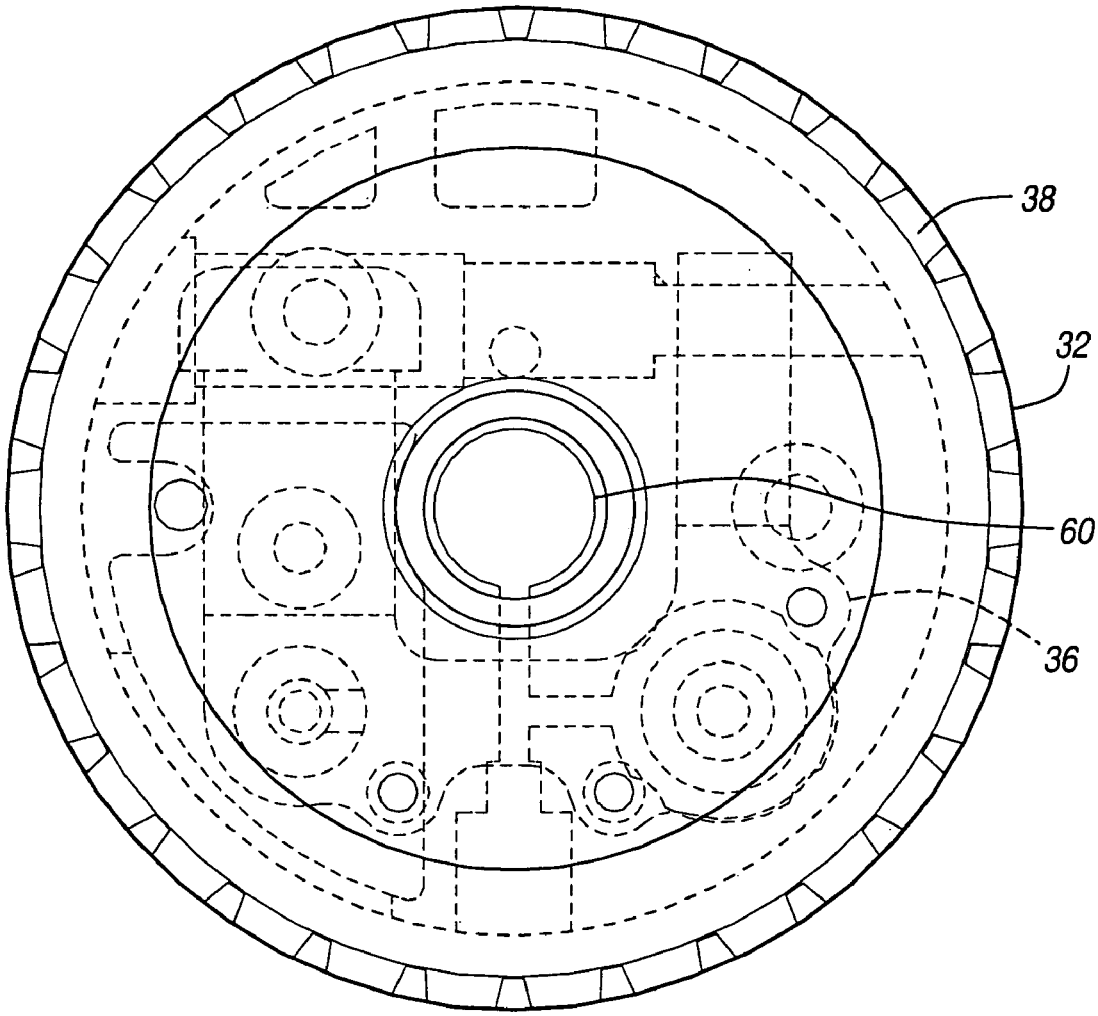

FIGS. 11*a* and 11*b* represent side and end views of an assembled mandrel collection system 32. Shown is the relationship between the orifices of the air supply module 34 and the vacuum control module 36. Defined within the shuttle chamber is a shuttle valve 120 which functions to regulate the flow of pressurized air from the constant air supply 110 to a vacuum transducer 115 that is disposed within the vacuum transducer chamber 108. As described below, the shuttle valve moves in response to movement of the actuating piston 44. Movement of the shuttle valve 120 regulates the flow of air from the constant air supply 110 to cause it to either pass a needle control valve 126 formed within the constant low flow needle valve control chamber 106 or through the high flow path 114. Flow of air through the vacuum transducer causes the vacuum port 118 to suck air into the venturi vacuum actuator, thus forming the vacuum within the collection bottle 38.

Figure 12A:
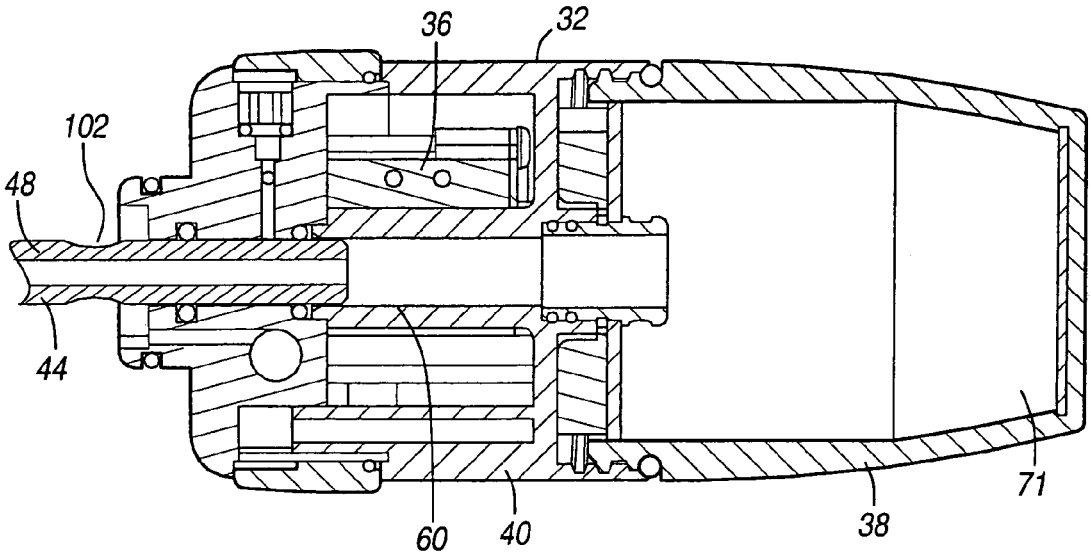
FIGS. 12*a*–12*b* represent side cross-sectional views of the mandrel collection system coupled to a hydraulic actuator of the rivet setting tool.
Figure 12B:
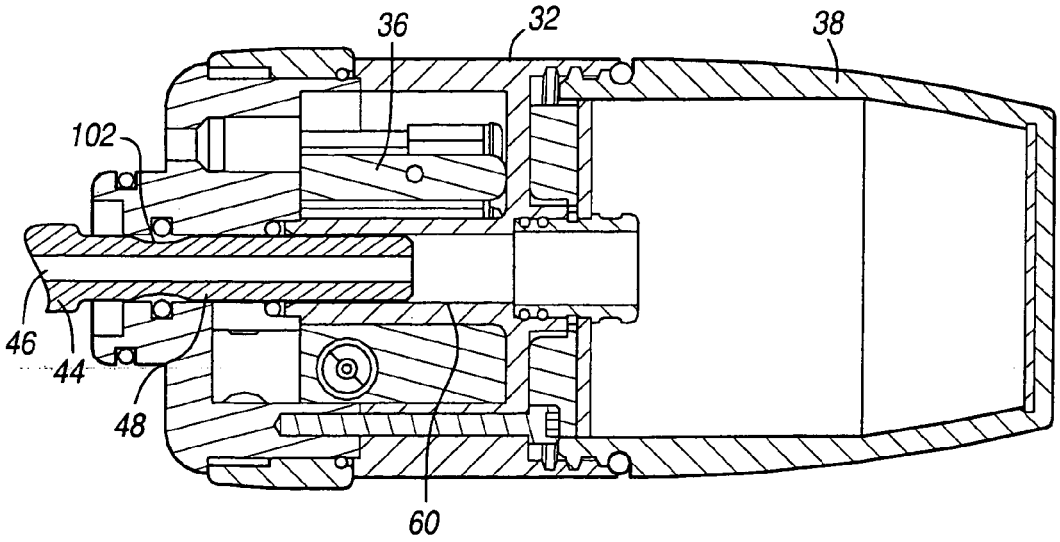

FIGS. 12*a*–12*b* show the activation of the mandrel collection system 32. Shown is the actuator piston 44 in its forward and first position. As can be seen, the first and second O-rings fluidly seal the chamber for holding the activation piston 50 from the mandrel collection system 32. Upon activation of the rivet setting tool 30, the actuation piston 44 withdraws into the mandrel collection system through bore 60 and actuates the actuating head 42 of the rivet setting tool. When the actuation piston 44 moves to its second position, the air passage, in the form of the notch 102 formed within the piston actuator allows pressurized air from the chamber for holding the actuated piston to bypass the first O-ring 96 and pressurize the chamber defined within the air supply module 34. The air path is provided by means of the notch 102 in the piston 44, which is placed beneath the first o-ring 96. This allows compressed air to flow from the chamber 50 to the mandrel collection system 32 to actuate the shuttle valve 120. The pressure within chamber 50 is maintained at about 85 psi by supply orifice 52.

Figure 13A:
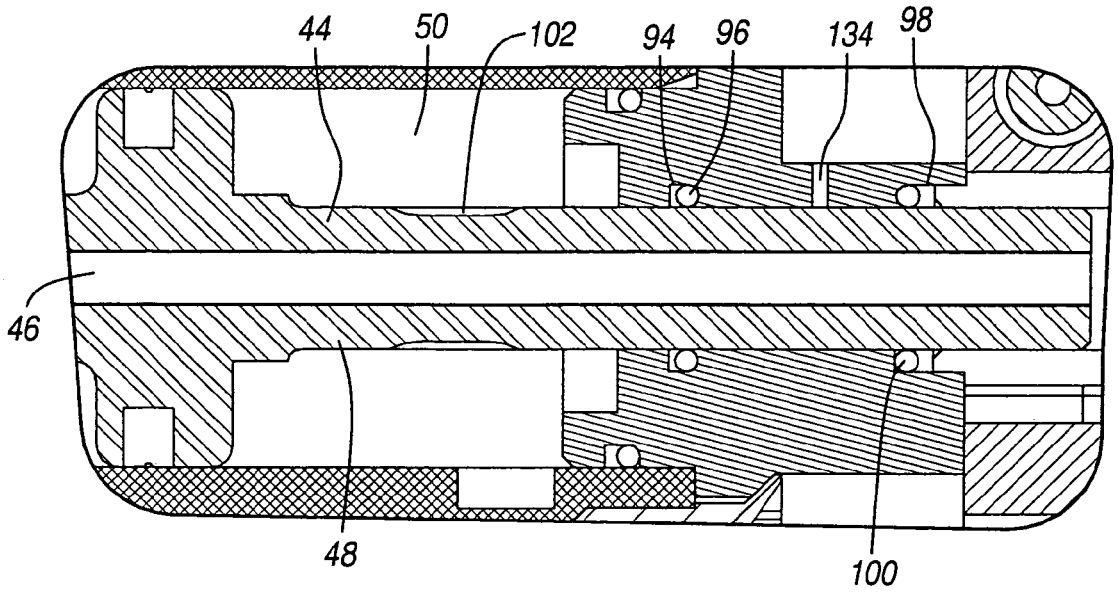
FIGS. 13*a*–13*b* represent close up cross-sectional views of the interaction of the hydraulic actuator with the mandrel collection system.
Figure 13B:
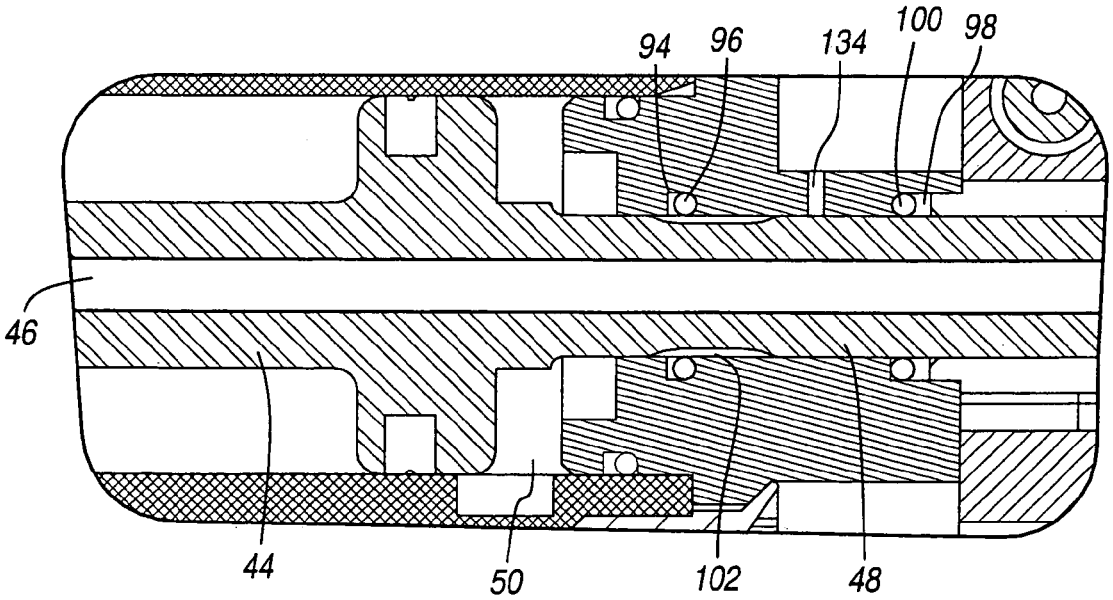

FIGS. 13*a* and 13*b* are close up cross-sectional views of the interaction between the actuation piston 44 and the air supply module. As seen, when the piston is in its second position, air bypasses the first O-ring and enters a control orifice 134. The control orifice 134 is fluidly coupled to the shuttle valve chamber 104, thus allowing flow through the orifice 134 to actuate the shuttle valve 120. It is envisioned that other sources of compressed air could be fluidly coupled to the shuttle valve chamber 104 to actuate the shuttle valve 120. The second o-ring 100 prevents compressed air from escaping from the chamber 50 into the collector bottle 38. In the normal position, the notch 102 is not positioned under the first o-ring 96. This prevents air from flowing from chamber 50 into the control orifice 134.

Figure 14:
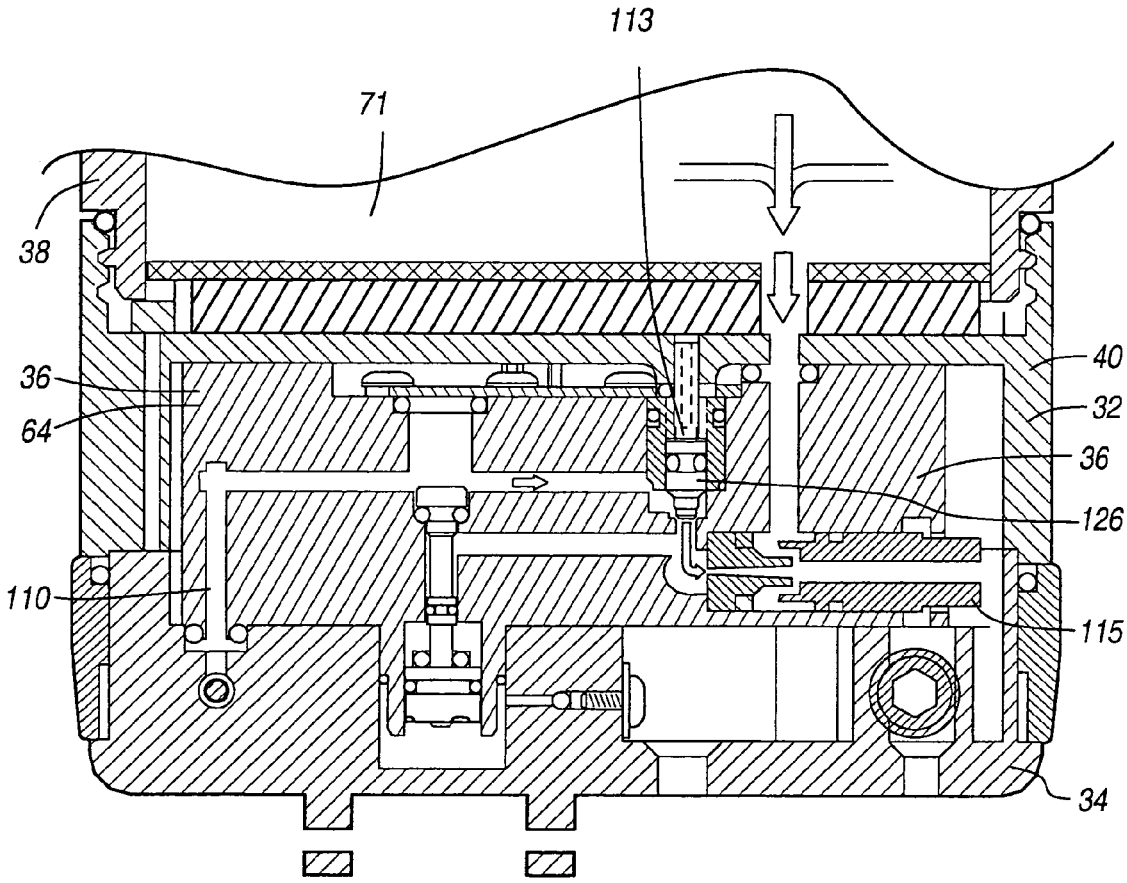
FIGS. 14–15 show cross-sectional views of the functioning of the mandrel collection system.

FIG. 14 represents the functioning of the mandrel collection system when the actuating piston 44 is in its first non-activated position. In this regard, the vacuum system generates a low level vacuum in the bottle. As can be seen, the shuttle valve 120 is in a non-actuated position. A constant flow of air is supplied through the constant air line 110 through the low flow passage 112 and past the constant low flow needle valve 113. This low flow air passes through the venturi vacuum transducer 115 to form a low level vacuum at the vacuum supply port 118.

Figure 15:
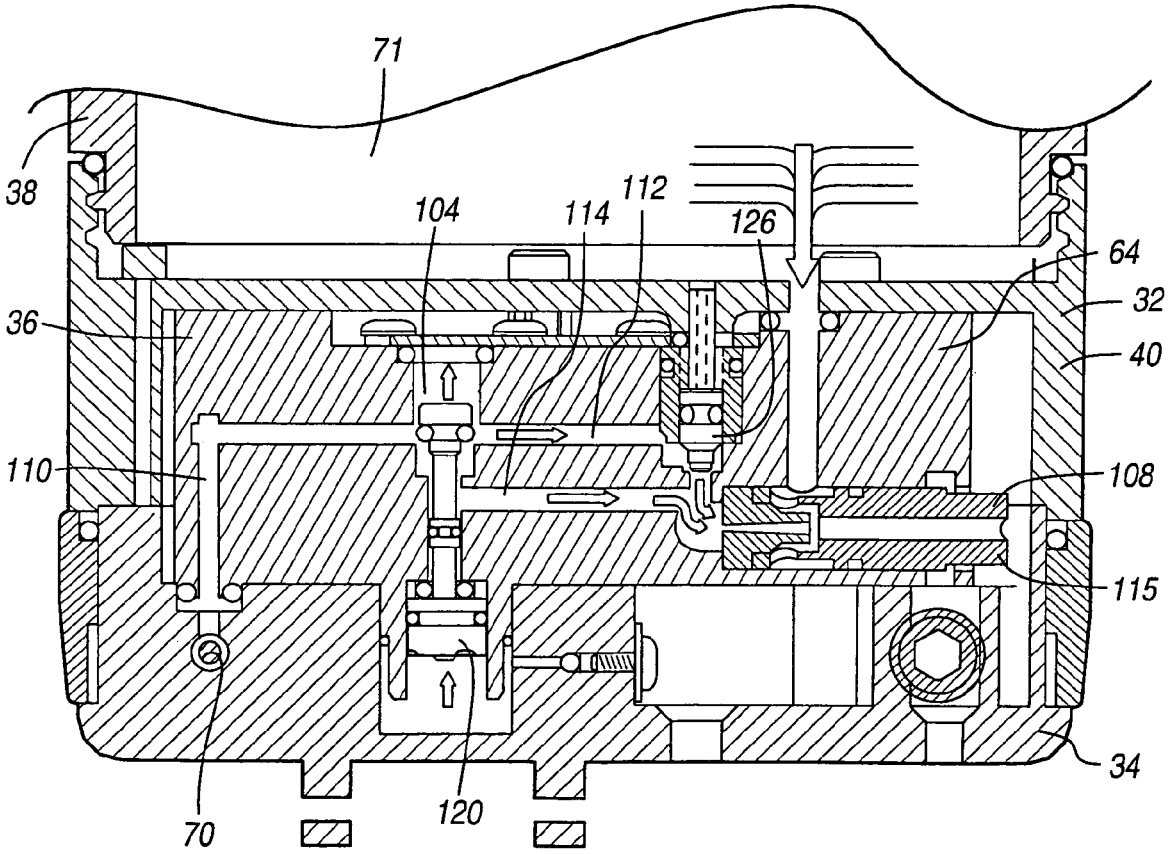

When the piston is moved into its second or actuated position (see FIG. 13*b*), air pressure passes the first O-ring 96 and enters the control orifice 134. As seen in FIG. 15, this air pressure from the control orifice 134 actuates the shuttle valve 120 and causes it to move to a second position 140. When the shuttle valve 120 is in its second position 140, air from the constant pressure supply 70 line flows through both the low and high flow passages 112, 114. This allows a high flow to enter the venturi vacuum actuator 115, allowing a high or large vacuum to be drawn through the vacuum supply 118. This high vacuum functions to pull the mandrel from the actuating head 42 and place the spent mandrel into the collection bottle 38. After a predetermined amount of time, the piston 44 is returned to its normal position. Air pressure bleeds through the orifice 76, returning the shuttle valve 120 to its unactuated position.

Figure 16A:
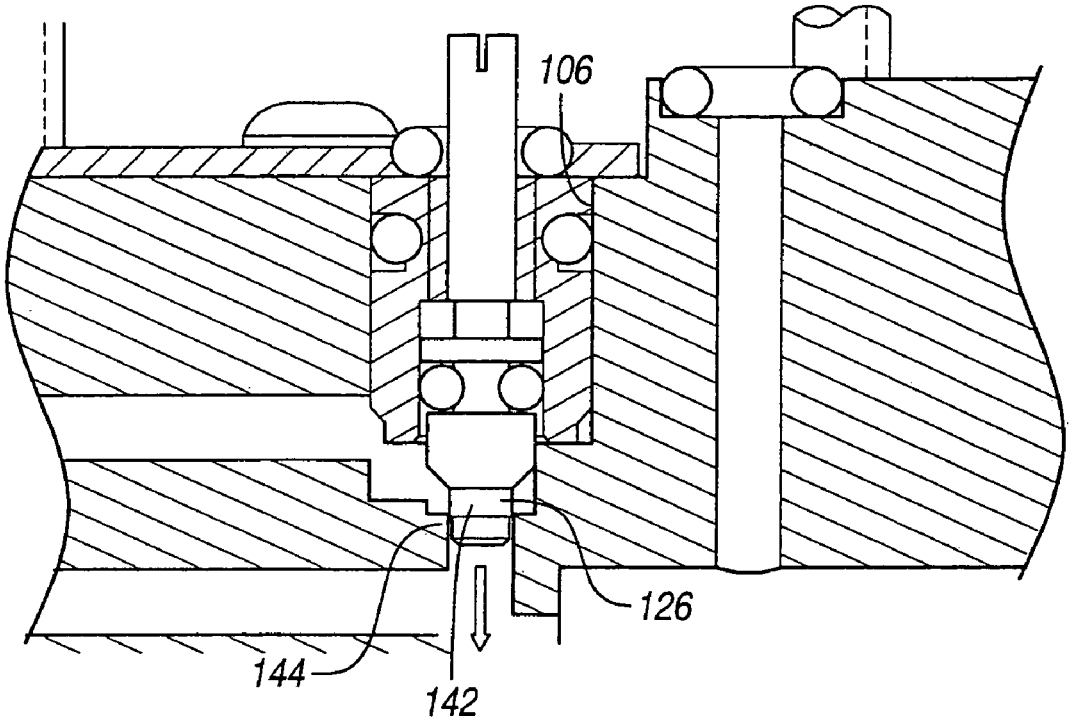
FIGS. 16*a*–16*b* show close ups of a control valve within the vacuum control mechanism.
Figure 16B:
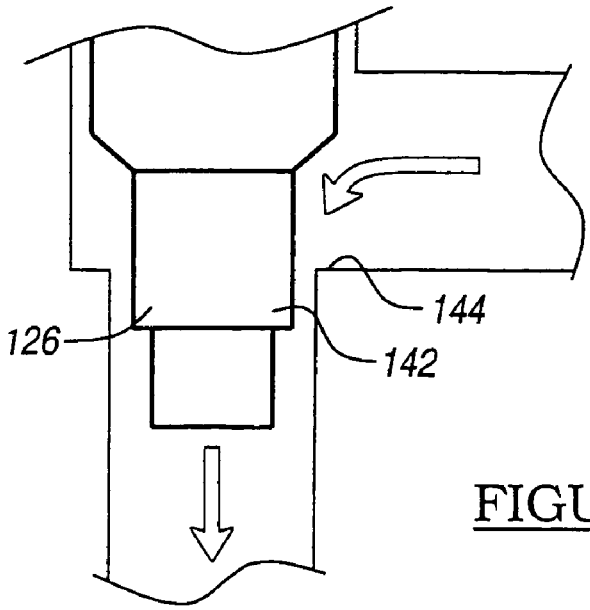

FIGS. 16*a*–16*b* are closer figures of the constant flow needle valve 113. In this regard, the position of a valve element 142 to a valve seat 144 is adjustable by a user by rotating a threaded member 146. In doing so, the user is able to adjust the low vacuum pressure from zero to full vacuum. The valve element 142 can be formed of a series of stepped diameters. Each diameter is configured to allow a specific flow rate through the valve via a predetermined restriction based on the clearance of the valve element 142 to the valve seat 144. For example, it is envisioned that while the high vacuum level would be sufficient to pull a mandrel, the low vacuum level may not.

Figure 17:
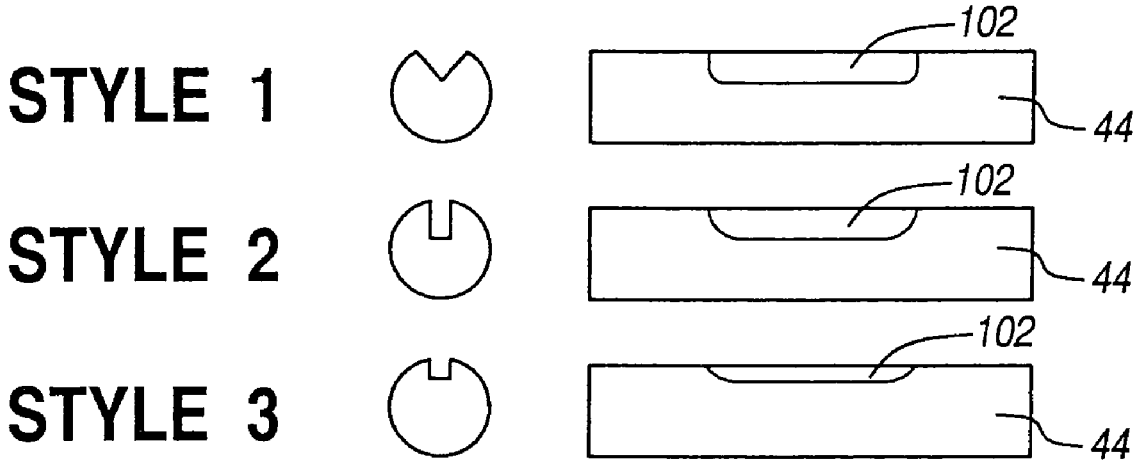
FIG. 17 represents three styles of notches used in the hydraulic actuator of the rivet setting tool.

FIG. 17 represents varying styles of air passages in the form of the notch 102 that can be formed into the activation piston 44. As can be seen, the profile of the notch 102 can be adjusted to vary the amount of flow to the control orifice 134. In this regard, the size and depth of the orifice may be adjusted to accommodate necessary flows without cutting the first O-ring.

The description of the invention is merely exemplary in nature and, thus, variations that do not depart from the gist of the invention are intended to be within the scope of the invention. For example, while a rivet setting tool is disclosed, the teachings of the present invention are equally applicable to other fastening tools. Additionally while the system is disclosed for removing a rivet mandrel, it is possible to use the teachings of the present invention in a fastener feeding system. Such variations are not to be regarded as a departure from the spirit and scope of the invention.

What is claimed is:

1. A hand held tool for setting a rivet comprising:

a rivet having a removable mandrel;

a mandrel collection system coupled to the rivet setting tool, the mandrel collection system configured to provide a first and second vacuum levels, said second vacuum level being sufficient to draw the mandrel from the rivet setting tool into the mandrel collection system, wherein the mandrel collection system comprises an air supply module;

a vacuum control module defining first and second fluid passages;

a venturi valve fluidly coupled to the first and second passages; and a shuttle valve movable from a first position to a second position, wherein the venturi valve receives fluid from the first fluid passage when the shuttle valve is in the first position and the venturi valve receives fluid from the second fluid passage when the shuttle valve is in the second position.

2. The hand held tool according to claim 1 wherein the first vacuum level is less than the second vacuum level.

3. The hand held tool according to claim 1 wherein the venture valve receives fluid from the first and second fluid passages when the shuttle valve is in the second position.

4. The hand held tool according to claim 1 wherein the venturi valve has passage fluidly coupled to the mandrel collection system.

5. The hand held tool according to claim 1 further comprising a cylindrical activation piston defining an air passage therethrough.

6. A hand held tool for setting a rivet comprising:

a rivet having a removable mandrel;

a mandrel collection system coupled to the rivet setting tool, the mandrel collection system configured to provide a first and second vacuum levels, said second vacuum level being sufficient to draw the mandrel from the rivet setting tool into the mandrel collection system, wherein the mandrel collection system comprises a shuttle valve which is moveable from a first position to a second position and wherein the mandrel collection system provides a first vacuum level when the shuttle valve is in a first position and a second vacuum level when the shuttle valve is in the second position;

a vacuum control module defining first and second fluid passages;

a venturi valve fluidly coupled to the first and second passages; and wherein the venturi valve receives fluid from the first fluid passage when the shuttle valve is in the first position and the venturi valve receives fluid from the second fluid passage when the shuttle valve is in the second position.

7. The hand held tool according to claim 6 wherein the shuttle valve is actuated by air pressure.

8. The held tool according to claim 6 wherein the mandrel collection system comprises a needle valve configured to regulate the first vacuum level.

9. An apparatus for setting a fastener having a mandrel, the apparatus comprising:

an air supply module;

a vacuum control module coupled to the air supply module;

a collection bottle defining a sealed collection cavity;

wherein the vacuum control module is configured to provide first and second vacuum levels within the sealed cavity, said second vacuum level being sufficient to draw the mandrel into the sealed cavity;

a vacuum control module defining low and high flow fluid passages;

a venturi valve fluidly coupled to the low and high passages; and a shuttle valve movable from a first position to a second position, wherein the venturi valve receives fluid from the low flow fluid passage when the shuttle valve is in the first position and the venturi valve receives fluid from the high flow fluid passage when the shuttle valve is in the second position.

10. The apparatus according to claim 9 wherein the vacuum control module is fluidly coupled to the air supply module.

11. The apparatus according to claim 9 wherein said high and low flow passages are fluidly coupled to a vacuum actuator.

12. The apparatus according to claim 11 comprising a needle valve configured to restrict air flow through the low flow passage.

13. The apparatus according to claim 12 wherein the shuttle valve is actuated by compressed air.

14. The apparatus according to claim 12 wherein the shuttle valve is actuated by movement of a rivet setting tool actuation piston.

15. The apparatus according to claim 14 wherein the actuation piston comprises an actuation air passage and wherein the shuttle valve is configured to move in response to compressed air flowing through the actuation air passage.

16. The apparatus according to claim 15 wherein the apparatus defines a pressure chamber fluidly coupled to the air actuation passage, said pressure chamber having a bleeder orifice configured to release air pressure from the pressure chamber at a predetermined rate.

17. The apparatus according to claim 16 wherein the pressure chamber has a bleeder disk, said bleeder orifice being defined within the bleeder disk.

18. The apparatus according to claim 9 wherein the first vacuum level is not sufficient to draw a fastener into the sealed cavity.

19. An apparatus for moving a portion of a fastener, the apparatus comprising:

a member defining a generally sealed cavity;

a vacuum control module configured to provide first and second vacuum levels within the sealed cavity, said second vacuum level being sufficient to draw the fastener through an actuator piston into the sealed cavity, said vacuum control module defining low and high pressure fluid passages;

a venturi valve fluidly coupled to the low and high pressure fluid passages; and a shuttle valve movable from a first position to a second position, wherein the venturi valve receives fluid from the low pressure fluid passage when the shuttle valve is in the first position and the venturi valve receives fluid from the high pressure fluid passage when the shuttle valve is in the second position.

20. The apparatus according to claim 19 wherein said low and high pressure passages are fluidly coupled to a vacuum actuator.

21. The apparatus according to claim 20 wherein the shuttle valve is configured to restrict the flow through the high air flow passage.

22. The apparatus according to claim 21 comprising a needle valve configured to restrict air flow through the low flow passage.

23. The apparatus according to claim 22 wherein the shuttle valve is actuated by compressed air.

24. The apparatus according to claim 22 wherein the shuttle valve is actuated by movement of a piston.

25. The apparatus according to claim 24 wherein the piston comprises an actuation air passage and wherein the shuttle valve is configured to move in response to compressed air flowing through the actuation air passage.

26. The apparatus according to claim 25 wherein the apparatus defines a pressure chamber fluidly coupled to the air actuation passage, said pressure chamber having a bleeder orifice configured to release air pressure from the pressure chamber at a predetermined rate.

* * * * *

UNITED STATES PATENT AND TRADEMARK OFFICE

CERTIFICATE OF CORRECTION

PATENT NO. : 7,043,807 B2
APPLICATION NO. : 11/199438
DATED : May 16, 2006
INVENTOR(S) : James N. Woyciesjes et al.

It is certified that error appears in the above-identified patent and that said Letters Patent is hereby corrected as shown below:

Title Page,
Item [75] Inventors, "Theordore" should be -- Theodore --.

Column 7,
Line 10, "venture" should be -- venturi --.
Line 42, after "The" insert -- hand --.

Signed and Sealed this

Twenty-second Day of August, 2006

JON W. DUDAS
*Director of the United States Patent and Trademark Office*